United States Patent [19]

Janssen

[11] 3,940,650

[45] Feb. 24, 1976

[54] ELECTRIC INCANDESCENT LAMP

[75] Inventor: Eduard Jozef Philomena Janssen, Eindhoven, Netherlands

[73] Assignee: U.S. Philips Corporation, New York, N.Y.

[22] Filed: Mar. 19, 1975

[21] Appl. No.: 559,821

[30] Foreign Application Priority Data

Mar. 25, 1974 Germany ..... 7410382[U]

[52] U.S. Cl. ..... 313/222; 313/271; 313/274; 313/279

[51] Int. Cl.[2] ..... H01K 1/18

[58] Field of Search ..... 313/222, 315, 271, 274, 313/279, 283, 284, 285, 286, 252, 253, 255, 244, 243

[56] References Cited

UNITED STATES PATENTS 3,831,053 8/1974 Holcomb et al. ..... 313/222

*Primary Examiner*—R. V. Rolinec
*Assistant Examiner*—Darwin R. Hostetter
*Attorney, Agent, or Firm*—Frank R. Trifari

[57] ABSTRACT

The invention relates to an electric incandescent lamp having a tubular envelope in which a coiled-coil filament is stretched which is supported in at least one place between the ends by a support formed from wire, of which support a part bears on the inner wall of the envelope and another part supports the filament, The part which supports the filament has a helical shape and, according to the invention, is present inside the secondary winding of the filament. The said part comprises at least two turns the winding sense of which corresponds to that of the secondary turns of the filament.

1 Claim, 2 Drawing Figures

ELECTRIC INCANDESCENT LAMP

The invention relates to an electric incandescent lamp, in particular a halogen incandescent lamp, comprising a tubular envelope which is closed at both ends by a pinch seal and in which a coiled-coil filament is stretched which extends coaxially in the envelope and which is supported in at least one place between the pinch seals by a support which is formed from a metal wire, of which support a first helically wound part supports the filament and of which a second part bears on the inner wall of the envelope. Such an incandescent lamp is known inter alia from the German Gebrauchsmuster No. 1955504.

In the electric incandescent lamp according to said Gebrauchsmuster the said first part of the support formed form metal wire consists of a single helical wire turn which is arranged around the secondary winding of the filament. The winding sense of said wire turn is opposite to that of the secondary winding of the filament. Said wire turn should be arranged around the secondary winding of the filament so solidly that the support cannot move axially in the envelope. It has been found, however, that the arrangement of the support can easily result in damaging of the filament.

It is the object of the invention to provide an electric incandescent lamp of the above mentioned type which does not exhibit the said drawback.

For that purpose, the electric incandescent lamp according to the invention is characterized in that the first part comprises at least two turns the winding sense of which corresponds to that of the secondary winding of the filament and which part is present inside the secondary winding of the filament. Since the winding sense of said first part of the support corresponds to that of the secondary winding of the filament, the support can be secured to the filament in that the said part of the support is screwed into the secondary winding of the filament which can be done without exerting force on the filament. In said screwing movement a part of the support which connects the first part to the second part, is moved between the turns of the secondary winding of the filament. Said part prevents the support from moving axially in the envelope. Since the said first part has at least two turns, its length is sufficient to support at least one secondary turn of the filament.

The invention will now be described in greater detail with reference to the accompanying drawing, in which.

Figure 1:
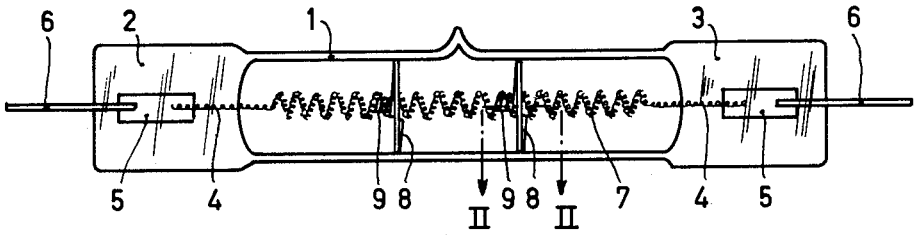
FIG. 1 shows an electric incandescent lamp according to the invention.
Figure 2:
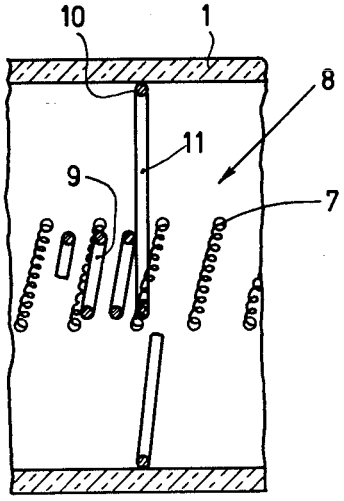
FIG. 2 is a detail II on an enlarged scale of FIG. 1.

The electric incandescent lamp shown in FIG. 1 comprises a tubular envelope 1 which is sealed at the ends by pinch seals 2 and 3. Lead-throughs 4, foils 5 and lead-outs 6 are sealed in said pinch seals in the usual manner. A coiled-coil filament 7 is stretched coaxially in the envelope and is supported in this embodiment in two places between the ends. For that purpose, supports 8 are present which are formed from wire material. Said supports comprise a first part 9 which has a helically wound shape and supports the filament (see also FIG. 2). The first part 9 in this embodiment comprises three turns and is present within the secondary winding of the filament. The support 8 furthermore comprises a second part 10 which bears on the inner wall of the envelope 1 so that the filament constantly assumes a coaxial position in the envelope. The part of the support denoted by 11 is present between two adjacent turns of the secondary winding of the filament and prevents the support from moving axially in the envelope. As is shown in FIG. 2, the winding sense of the helically wound first part of the support corresponds to that of the secondary winding of the filament.

What is claimed is:

1. An electric incandescent lamp, in particular a halogen incandescent lamp, comprising a tubular envelope which is closed at both ends by a pinch seal and in which a coiled-coil filament is stretched which extends coaxially in the envelope and which is supported in at least one place between the pinch seals by a support which is formed from a metal wire, of which support a first helically wound part supports the filament and a second part bears on the inner wall of the envelope, characterized in that the first part comprises at least two turns, the winding sense of which corresponds to that of the secondary winding of the filament and which part is present inside the secondary winding of the filament.

* * * * *